US010641021B2

(12) United States Patent
Schneider et al.

(10) Patent No.: US 10,641,021 B2
(45) Date of Patent: May 5, 2020

(54) MAGNETIC SAFETY GATE LATCH

(71) Applicant: BARRETTE OUTDOOR LIVING, INC., Middleburg Heights, OH (US)

(72) Inventors: Christopher Michael Schneider, Mays Landing, NJ (US); Craig Kime, Middleburg Heights, OH (US); Antonello Nizzia, Middleburg Heights, OH (US); Christopher John Heritage, Middleburg Heights, OH (US)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 888 days.

(21) Appl. No.: 15/281,148

(22) Filed: Sep. 30, 2016

(65) Prior Publication Data

US 2018/0094465 A1 Apr. 5, 2018

(51) Int. Cl.
*E05C 19/16* (2006.01)
*E05B 65/00* (2006.01)
(Continued)

(52) U.S. Cl.
CPC ..... *E05C 19/163* (2013.01); *E05B 1/0092* (2013.01); *E05B 47/004* (2013.01);
(Continued)

(58) Field of Classification Search
CPC .... E05C 19/163; E05C 19/16; E05B 65/0007; E05B 65/0014; E05B 47/004;
(Continued)

(56) References Cited

U.S. PATENT DOCUMENTS 466,186 A * 12/1891 Rohrbach ..... E05B 85/22 292/165
478,556 A * 7/1892 Bettmann, Jr. ..... E05C 1/14 292/170

(Continued)

FOREIGN PATENT DOCUMENTS

EP 1657383 A1 * 5/2006 ..... E05B 65/0014
EP 2913472 A1 9/2015

(Continued)

OTHER PUBLICATIONS

D&D Technologies, "Magna Latch", Product Information, retrieved on Dec. 8, 2016 from http://www.fencingandawning.com/fencing/ddgatelocking.pdf, 9 Pages.

(Continued)

*Primary Examiner* — Christine M Mills
(74) *Attorney, Agent, or Firm* — John Maldjian; Maldjian Law Group LLC

(57) ABSTRACT

Magnetic safety gate latch assembly including a first subassembly and a second subassembly. The first subassembly includes: a vertically-oriented pool latch tube; a lift mechanism coupled to the top end of the pool latch tube; a shaft vertically oriented within the pool latch tube, coupled to the lift mechanism, and having a lower end including a helical thread; a magnet and magnet housing, the magnet housing coupled to the helical threading of the shaft; and a bottom cover coupled to the lower end of the pool latch tube and enclosing the magnet housing, the bottom cover including an aperture on a vertical side facing a latch pin housing, the aperture positioned to expose the magnet. The second subassembly includes the latch pin housing; a ferromagnetic latch pin; and a magnetic latch pin guide coupled to the latch pin housing and slidably enclosing at least a portion of the latch pin.

14 Claims, 15 Drawing Sheets

(51) Int. Cl.
*E05B 47/00* (2006.01)
*E05B 1/00* (2006.01)

(52) U.S. Cl.
CPC ..... *E05B 47/0038* (2013.01); *E05B 47/0046* (2013.01); *E05B 65/0007* (2013.01); *E05C 19/16* (2013.01); *Y10T 292/11* (2015.04)

(58) Field of Classification Search
CPC ..... E05B 47/0038; E05B 47/0046; E05B 1/0092; Y10T 292/11; Y10T 292/0863; Y10T 292/0864; Y10T 292/0867; Y10T 292/0886; Y10T 292/0887; Y10T 292/0891; Y10T 292/1063; Y10T 292/1064; Y10T 292/1071; Y10T 292/1072; Y10S 292/29
USPC ..... 292/251.5, 57, 58, 60, 63, 64, 67, 230, 292/231, 237, 238, DIG. 29
See application file for complete search history.

(56) References Cited

U.S. PATENT DOCUMENTS 487,077 A * 11/1892 Rapson ..... E05B 15/0093 292/230
580,404 A * 4/1897 Keagle ..... E05B 53/001 292/255
1,602,264 A * 10/1926 Hutchison ..... E05C 1/04 292/60
1,706,102 A * 3/1929 Booth ..... E05B 17/2076 292/60
2,183,291 A * 12/1939 Haught ..... E05B 65/0007 70/141
2,497,425 A * 2/1950 Terry ..... F23L 13/02 126/285 R
2,532,881 A * 12/1950 Barnes ..... E05F 11/00 292/63
2,729,486 A * 1/1956 Evans ..... E05B 65/0053 292/92
3,174,314 A * 3/1965 Johnson ..... E05B 65/0007 70/77
3,282,617 A * 11/1966 Wason ..... E05B 65/0007 292/171
3,311,395 A * 3/1967 Leonard ..... E05B 65/0014 292/228
3,325,202 A * 6/1967 Mateja ..... E05B 15/0046 292/181
4,142,749 A * 3/1979 Heald ..... E05B 65/0007 292/130
4,226,450 A * 10/1980 Kerr ..... E05B 65/0007 292/59
4,822,085 A 4/1989 Guity-Mehr
5,362,116 A * 11/1994 Doyle ..... E05C 19/163 292/144
5,394,716 A 3/1995 Dreyer
5,469,659 A 11/1995 Reid et al.
5,664,769 A * 9/1997 Sadinsky ..... E04H 4/06 256/25
5,738,389 A * 4/1998 Marks ..... E05C 17/166 292/63
6,652,009 B2 11/2003 Fisher et al.
6,666,435 B2 * 12/2003 Blosfelds ..... E05C 19/16 256/24
7,044,511 B2 * 5/2006 Kliefoth ..... E05C 19/163 292/251.5
7,065,922 B1 * 6/2006 De Kruijf ..... E05B 65/0014 292/212
7,100,405 B2 * 9/2006 West ..... E05B 19/04 292/13
7,267,378 B2 9/2007 Drumm
7,355,515 B2 4/2008 Lee et al.
7,408,433 B1 8/2008 Irwin
7,472,569 B2 * 1/2009 Talpe ..... E05B 65/0007 292/164
7,481,471 B2 * 1/2009 Andersen ..... E05B 47/0046 292/251.5
7,520,542 B1 * 4/2009 Price ..... E05B 63/20 256/65.13
7,627,985 B2 * 12/2009 Marsden ..... E05B 65/0014 49/394
8,365,561 B2 2/2013 Chang
8,376,421 B2 * 2/2013 Simmonds ..... E05B 15/101 292/251.5
8,393,653 B2 * 3/2013 Clark ..... E05B 13/002 292/137
8,505,989 B2 * 8/2013 Wells ..... E05B 63/248 292/177
8,607,502 B2 * 12/2013 Flannery ..... E05F 15/50 292/170
8,887,441 B2 * 11/2014 Lundh ..... E05B 43/00 49/55
9,238,926 B2 * 1/2016 Guerrero ..... E05B 17/2076
9,279,284 B1 * 3/2016 Axelrod ..... E06B 11/02
9,303,435 B2 * 4/2016 Simmonds ..... E05C 1/08
9,523,219 B2 * 12/2016 Macernis ..... E05B 47/004
9,587,426 B1 * 3/2017 Flannery ..... E06B 9/04
10,072,442 B2 * 9/2018 Smith ..... E05B 41/00
10,082,544 B2 * 9/2018 Smith ..... E05B 43/005
10,415,290 B1 * 9/2019 Flannery ..... E06B 11/022
2005/0210938 A1 * 9/2005 Doyle ..... E05C 19/163 70/276
2006/0231821 A1 * 10/2006 Gavin ..... E06B 11/02 256/73
2007/0007775 A1 1/2007 Gallas et al.
2007/0022666 A1 2/2007 Andersen et al.
2007/0200360 A1 8/2007 Cavallucci et al.
2011/0148126 A1 * 6/2011 Macernis ..... E05B 65/0007 292/251.5
2013/0249221 A1 * 9/2013 Arssinous ..... E05C 1/12 292/173
2014/0035302 A1 2/2014 Koch et al.
2014/0054904 A1 * 2/2014 Andrews ..... E05C 19/163 292/144
2014/0319850 A1 10/2014 Berger et al.
2015/0015002 A1 * 1/2015 Macernis ..... E05B 63/244 292/251.5
2015/0337575 A1 11/2015 Macernis
2016/0002955 A1 * 1/2016 Smith ..... E05B 27/00 292/251.5
2016/0060924 A1 * 3/2016 Singh ..... E05B 65/0007 292/251.5
2017/0152682 A1 * 6/2017 Mizner ..... E05B 9/08
2018/0094466 A1 * 4/2018 Schneider ..... E05B 9/02
2018/0259595 A1 * 9/2018 Smith ..... G01R 33/02

FOREIGN PATENT DOCUMENTS

FR 2836946 A1 * 9/2003 ..... E05B 65/0014
FR 2861124 A1 * 4/2005 ..... E05D 11/1007
FR 2861126 A1 * 4/2005 ..... E05F 7/02
FR 2871509 A1 * 12/2005 ..... E05B 65/0007
FR 3002268 A1 * 8/2014 ..... E05C 1/04
FR 3002269 A1 * 8/2014 ..... E06B 11/085
WO WO-2007070977 A1 * 6/2007 ..... E05B 47/023
WO WO-2008111107 A2 * 9/2008 ..... E05B 65/0014
WO WO-2011088496 A1 * 7/2011 ..... E05B 65/0007

OTHER PUBLICATIONS

Safetech Hardware LLC, "World's Safest Pool Gate Latch—Trilatch", SL-50-TRI, Product Information, retrieved on Dec. 8, 2016 from http://www.safetechhardware.com/category-safest-pool-latch.html, 2 Pages.
Hoover Fence Company, "The Protector™ Jr. Magnetic Gate Latch", Online Fence Resource, 1976, retrieved on Dec. 8, 2016 from http://www.hooverfence.com/catalog/hardware/protectorjr.htm, 1 Page.

* cited by examiner

100

AT CLOSED POSITION, END OF MAGNET IS FACING TOWARD STEEL LATCH PIN, ATTRACTING IT INTO LATCH GROOVE

DETAIL L
CLOSED
POSITION

TOP LID IS LIFTED TO ACTIVATE,
SPINS MAGNET AND
PIN DISENGAGES

DETAIL M, OPEN

SECTION N-N

MAGNETIC SAFETY GATE LATCH

BACKGROUND

Fences and fence gates typically are installed in outdoor areas, such as lawns, yards, gardens outdoor decks, and so forth. A fence or a fence gate includes one or more posts fixed to the ground, an upright coupled to each post, and rails coupled to the upright.

Fences are often installed around swimming pools in order to control physical access to the pool. In particular, a goal of the fence is to prevent young children from entering a pool area without adult supervision, because of a risk of drowning. Similarly, the fence may be used to prevent children who have been allowed to be in the pool area from leaving the pool area without adult supervision. Such fences may also be mandated by local ordinances around a swimming pool. Usage of a fence in this way is not limited to swimming pools, but also may be used around substantially any attractive nuisance that could be dangerous if not properly supervised.

The fence will include a gate to allow persons to enter and to exit the pool area. A conventional latch or doorknob to keep the gate closed suffers drawbacks such as being reachable by small children or, in the case of a latch, may be prone to not being closed securely. The gate should be operable by adults but not by children. Furthermore, it is not unusual for adults using a swimming pool to leave and reenter several times, e.g., to get drinks or food, check on something within a house, and so forth. Such persons often do not carry keys.

Thus, there is a need for a way to operate a gate in a way that is simple for adults, yet is difficult or impossible for small children.

SUMMARY

Embodiments of the invention generally are directed to a latching apparatus for a gate. In particular, embodiments provide a magnetically-operated latch for use in a gate surrounding a swimming pool.

Embodiments in accordance with the present disclosure include a magnetic safety gate latch assembly including a first subassembly and a second subassembly. The first subassembly includes: a vertically-oriented pool latch tube; a lift mechanism coupled to the top end of the pool latch tube; a shaft vertically oriented within the pool latch tube, coupled to the lift mechanism, and having a lower end including a helical thread; a magnet and magnet housing, the magnet housing coupled to the helical threading of the shaft; and a bottom cover coupled to the lower end of the pool latch tube and enclosing the magnet housing, the bottom cover including an aperture on a vertical side facing a latch pin housing, the aperture positioned to expose the magnet. The second subassembly includes the latch pin housing; a ferromagnetic latch pin; and a magnetic latch pin guide coupled to the latch pin housing and slidably enclosing at least a portion of the latch pin.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that presently are preferred, it being understood, however, that the embodiments disclosed herein are not limited to the specific instrumentalities disclosed. Included in the drawings are the following figures.

Figure 1A:
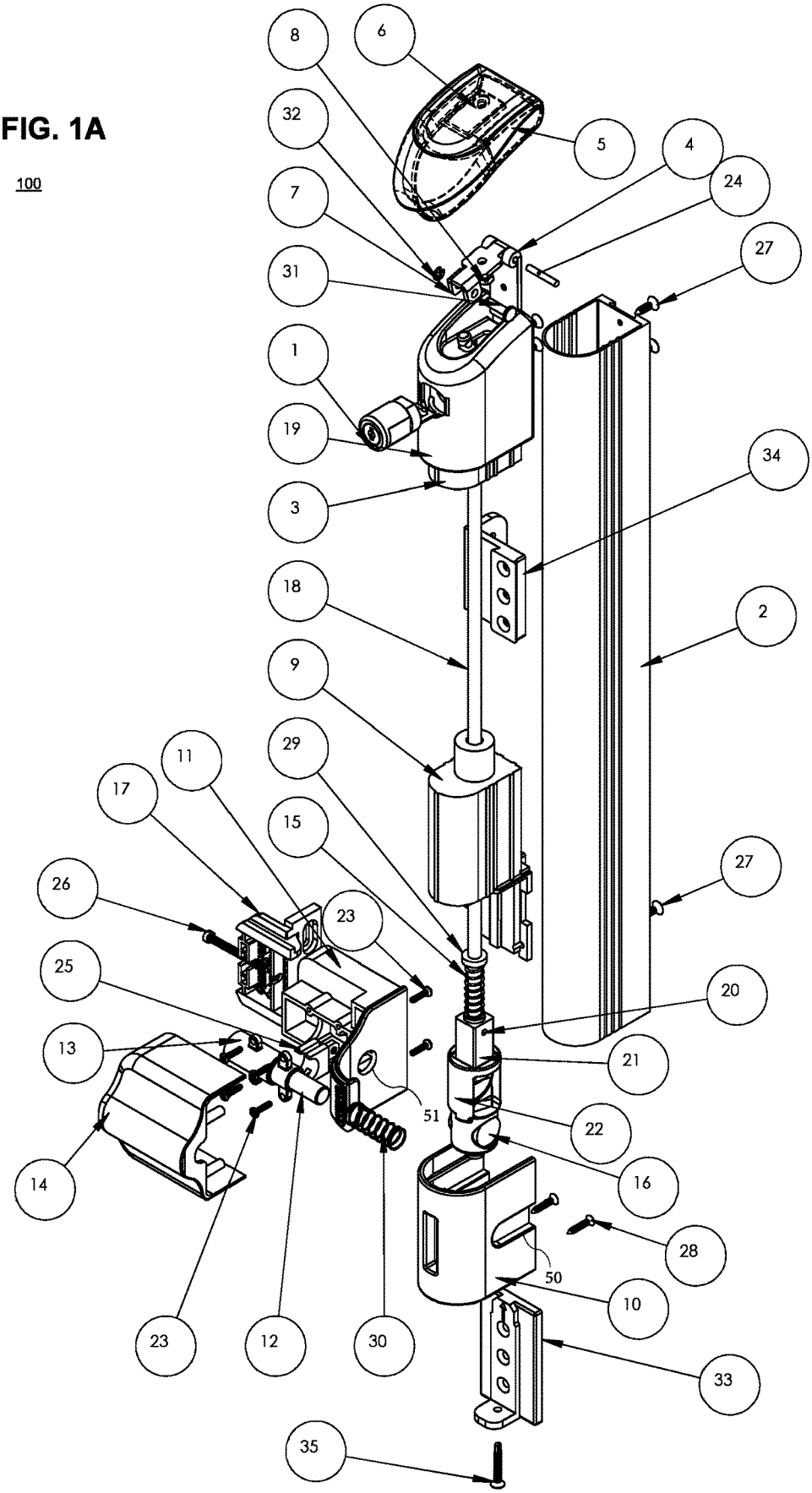
FIG. 1A is an exploded oblique view of a magnetic safety gate latch system, in accordance with an embodiment of the present disclosure.

While embodiments of the present invention are described herein by way of example using several illustrative drawings, embodiments of the invention are not limited to the embodiments or drawings described. The drawings and the detailed description thereto are not intended to limit the present invention to the particular form disclosed, but also encompass all modification, equivalents and alternatives falling within the spirit and scope of embodiments of the present invention as recited by the claims.

The headings used herein are for organizational purposes only and are not meant to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" may be used interchangeably herein. The terms "comprising", "including", and "having" also may be used interchangeably.

Embodiments in accordance with the present disclosure provide a latching apparatus for a gate, the latching apparatus incorporated with a fence post adjacent to the gate. A magnetic force from a permanent magnet may be used to keep a locking element in a locked position. The locking element may be spring-loaded such that the latching element relaxes to an unlocked state when the magnetic force from the magnet is disrupted or removed. In particular, the magnetic force may be disrupted when the magnet is rotated to break a magnetic field, or if the magnetic field is otherwise blocked.

In particular, embodiments in accordance with the present disclosure may provide a latch pin made of a magnetic material (e.g., steel), which cooperatively engages with a moveable magnet. One of the latch pin and the magnet may be coupled to a gate, and the other of the latch pin and the magnet may be coupled to a fence post. The fence post and the gate may be oriented adjacent to each other when the gate is closed.

Embodiments are usable in various gate and post configurations. For example, embodiments are usable with either a gate for which swing hinges used to swing the gate itself are installed on the right side of the gate, or a gate for which swing hinges are installed on the left side of the gate. Embodiments are also usable with gates that swing inward toward a pool area when the gate is opened, or outward away from the pool area when the gate is opened. With respect to components described in further detail below and in FIG. 1, customization for various gate and post configurations may include whether magnetic latch pin 12, and the assembly immediately surrounding it, is installed to the left or to the right of magnet 16. FIGS. 1 through 5E illustrate a configuration that may represent, e.g., a pool latch tube 2 coupled to a right-handed gate, and magnetic latch pin 12 coupled to a fence post toward the left; or, FIGS. 1 through 5E may illustrate a configuration that represents a pool latch tube 2 coupled to a fence post toward the right of a left-handed gate, and magnetic latch pin 12 coupled to the left-handed gate. Some configurations may use a mirror image of the illustration of FIG. 1, e.g., pool latch tube 2 coupled to a fence post to the left of a right-handed gate and magnetic latch pin 12 coupled to the right-handed gate, to the right of the pool latch tube 2.

In one embodiment, when the latch is in a closed position, an end of the magnet will face the latch pin and attract the latch pin by magnetic force. The latch pin so attracted will move into a latch groove. When the latch pin is in the latch groove, the gate will be locked and cannot be opened without damaging the gate.

FIG. 1 illustrates an exploded oblique view of a magnetic safety gate latch assembly 100 in accordance with an embodiment of the present disclosure. Latch assembly 100 may be manufacturable in a variety of heights, with a specific height selected by a customer or installer according to customer need or preference. For example, latch assembly 100 may be manufactured and installed such that a top of latch assembly 100 is about 5-6 feet above the ground, and extends downward to within a few inches of the ground.

Latch assembly 100 includes an elongated pool latch tube 2, oriented such that an axis of the elongated direction of pool latch tube 2 is vertical. Pool latch tube 2 may be attached to either a gate side or a post side of a gated opening in a fence by use of pool latch bracket 34. Pool latch tube 2 houses a mechanism that mechanically transmits a force or action provided by a user, at or near a top end of pool latch tube 2, to a gate locking mechanism at or near a bottom end of pool latch tube 2. For example, a lift mechanism may be used by the user to provide the force or action to be transmitted.

Pool latch tube 2 is coupled at a top end to a pool latch tube top tube cover 19. Top tube cover 19 may include a pool latch top insert 3, which may be inserted into pool latch tube 2 when assembled, to help couple and stabilize top tube cover 19 to pool latch tube 2. Insert 3 may have a smaller cross-sectional size in a horizontal plane, compared to top tube cover 19 and pool latch tube 2, in order to facilitate insertion of insert 3 into pool latch tube 2. Screw(s) 27 also may be used to help couple and stabilize top tube cover 19 to pool latch tube 2. Alternatively, insert 3 may have a larger cross-sectional size in a horizontal plane, compared to pool latch tube 2, in order to facilitate insertion of insert 3 over the outside of pool latch tube 2.

Top tube cover 19 may be coupled to the lift mechanism. In the embodiment illustrated in FIG. 1, the lift mechanism may include pool latch lid 5 mounted to pool latch cover hinge 4, such that pool latch lid 5 may be rotationally coupled to top tube cover 19. The rotational coupling may be by way of pool latch cover hinge 4 and pool latch hinge pin 24. Pool latch lid 5 is further coupled to hinge base 7 by a fastener 6 (e.g., a cap bolt) and nut 8 that threads onto fastener 6. Hinge base 7 may be coupled further to a top end of twist drive shaft 18, e.g., by way of clevis pin 31 configured to pass through cooperating apertures in hinge base 7 and twist drive shaft 18, and secured in place by clip 32.

A user operates latch assembly 100 by pulling up on pool latch lid 5, such that pool latch lid 5 rotates around an axis of rotation formed by pool latch hinge pin 24. As pool latch lid 5 is pulled up, twist drive shaft 18 also is pulled up. Twist drive shaft 18 may be spring loaded such that, absent an upward force from pool latch lid 5, twist drive shaft 18 is pushed or pulled to a lower resting position. Twist drive shaft 18 provides a mechanical linkage to transmit force from pool latch lid 5 to the gate locking mechanism at or near a bottom end of pool latch tube 2, as described below in further detail.

In some embodiments, latch assembly 100 may include an optional pool latch lock assembly 1, which may be a lockable assembly (e.g., key-operated or combination code operated) used by a user to enable or to prevent (depending upon the locked state of pool latch lock assembly 1) twist drive shaft 18 from being pulled up sufficiently to actuate the gate locking mechanism at or near a bottom end of pool latch tube 2. In some embodiments, pool latch lock assembly 1 may be partially or completely hidden behind a portion of pool latch lid 5. The purpose of being hidden would be to provide a more aesthetically pleasing appearance. In those embodiments, pool latch lock assembly 1 may allow a relatively small amount of movement or "play" vertically of twist drive shaft 18 and/or pool latch lid 5, such that when pool latch lock assembly 1 is in a locked state, pool latch lid 5 may be lifted up enough to expose pool latch lock assembly 1 so it can be unlocked, without causing the gate locking mechanism at or near a bottom end of pool latch tube 2 to be actuated or attempted to be actuated. In some embodiments, pool latch lock assembly 1 may be prevented from being locked when the gate locking mechanism is in an open state.

Figure 3A:
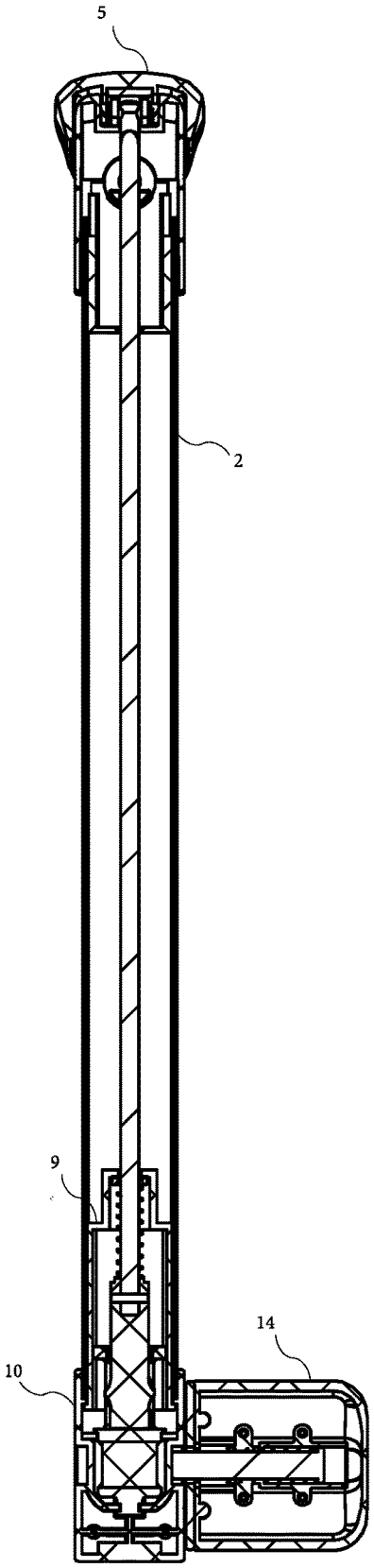
FIG. 3A is a cross-sectional rear plan view of a magnetic safety gate latch system in a locked position, in accordance with an embodiment of the present disclosure.

Pool latch tube 2 is coupled at a bottom end to a pool latch tube bottom cover 10, e.g., by insertion into pool latch tube bottom cover 10 as better shown in FIG. 3A. In turn, pool latch tube bottom cover 10 is coupled to pool latch base 33 (e.g., by sliding onto pool latch base 33 and/or use of fastener(s) 28). Pool latch base 33 in turn is rigidly coupled to a fence element (e.g., gate, post, or upright), not illustrated in FIG. 1A. Fastener 35 may be used to further secure pool latch base 33 to pool latch tube bottom cover 10, as further illustrated in FIG. 2E. Bottom cover 10 may include a pool latch bottom insert 9, which may be inserted into pool latch tube 2 when assembled, to help couple and stabilize bottom cover 10 to pool latch tube 2. Insert 9 may have a smaller cross-sectional size in a horizontal plane, compared to bottom cover 10 and pool latch tube 2, in order to facilitate insertion of insert 9 into pool latch tube 2. Screw(s) 27 also may be used to help couple and stabilize bottom cover 10 to pool latch tube 2.

Bottom cover 10 faces a housing formed from pool latch lock pin base cover 11 and pool latch cover 14, illustrated in exploded form in FIG. 1. Lock pin base cover 11 is coupled to a fence post if pool latch tube 2 is coupled to a gate. Conversely, if pool latch tube 2 is coupled to a fence post then lock pin base cover 11 will be coupled to a gate.

The housing formed by lock pin base cover 11 and pool latch cover 14 may be held together by screws 23. The housing may enclose a spring-loaded magnetic latch pin 12, which in turn is enclosed by magnetic latch pin guide 13. Magnetic latch pin 12 is made from a ferromagnetic material (e.g., steel or iron). In some embodiments, magnet latch pin 12 itself also may be a permanent magnet. Magnetic latch pin 12, as disposed within the housing, is aligned with aperture 51 in the housing. More specifically, magnetic latch pin 12 and aperture 51 in the housing are collinear within a horizontal plane. In addition, if magnetic latch pin 12 is a magnet, then the north (N) and south (S) magnetic poles of magnetic latch pin also are within the horizontal plane, and oriented to have a predetermined magnetic pole (either N or S) oriented toward aperture 51 in the housing. Aperture 51 in the housing faces bottom cover 10 and is aligned with cooperating latch groove 50 in bottom cover 10 when the gate is in a closed position. Respective latch grooves 50 may be formed in both vertical sides of bottom cover 10 in order to accommodate an installation as illustrated in FIG. 1, or installation that is a mirror image of FIG. 1. Threaded adjuster 25 may be used to help maintain alignment of magnetic latch pin 12 with aperture 51 in the housing.

Latch groove 50 and aperture 51 are sized to permit magnetic latch pin 12 to pass through each at least partially. Therefore, the diameters of both latch groove 50 and aperture 51 should be at least as large as the diameter of magnet latch pin 12. The diameters of latch groove 50 and aperture 51 should be somewhat larger in order to allow for tolerance in mismatch arising from initial installation and usage or aging over time. However, the diameters of latch groove 50 and aperture 51 should not be excessively large compared to the diameter of magnet latch pin 12, because excessive size may allow excessive relative movement between the gate and the fence post, even when the gate is locked. In some embodiments, the diameters of latch groove 50 and aperture 51 should be about 25% larger than the diameter of the magnet latch pin 12.

Spring 30 may be used to load magnetic latch pin 12 such that in a relaxed state (i.e., not magnetically attracted), magnet latch pin 12 is retracted within the housing formed by lock pin base cover 11 and pool latch cover 14. Spring 30 may be located inside magnetic latch pin guide 13, as better illustrated in FIG. 4A and FIG. 4I. In an attracted state (i.e., magnetically attracted to a cooperating magnetic or ferromagnetic material within bottom cover 10), magnetic latch pin 12 may be pulled partially through latch groove 50 and aperture 51. In the attracted state, magnetic latch pin 12 acts as a physical barrier to prevent the gate from being opened relative to the fence post, because magnetic latch pin 12 will be situated partially within latch groove 50 and partially within aperture 51. The housing and bottom cover 10 will not be able to move significantly relative to each other because, as they move, latch groove 50 and aperture 51 no longer would be collinearly aligned with magnetic latch pin 12. A significant movement is one that would allow the gate to open sufficiently to allow a person to pass through the gate. Within the housing formed by lock pin base cover 11 and pool latch cover 14, pool latch lock pin base bracket 17 and adjustment screw 26 together may be used to maintain the proper placement and alignment of magnetic latch pin 12.

Magnetic latch pin 12 may be sized in order to be sufficiently stiff in order to prevent opening of a pool gate relative to a pool fence post when a horizontal force is applied by a person, e.g., a child who is being prevented from entering or exiting a pool area, while magnetic latch pin 12 is in the attracted state. In some embodiments, the horizontal force may be at least about 20 pounds of pressure. In some embodiments, magnetic latch pin 12 may be a cylindrical rod having a length of about four inches and a diameter of about 0.5 inches.

A magnet 16 is rotatably situated within pool latch bottom insert 9, such that the N and S poles of magnet 16 are in the same plane as magnetic latch pin 12, latch groove 50 and aperture 51. Magnet 16 is oriented such that in an attracted state (i.e., pool latch lid 5 not being actuated and the gate is locked), magnet 16 and magnetic latch pin 12 face each other and are magnetically attracted to each other, such that apparatus 100 is in a locked position.

If magnetic latch pin 12 is a magnet, then magnet 16 and magnetic latch pin 12 ordinarily may face each other with opposite poles so that they magnetically attract each other. For example, if a N pole of magnetic latch pin 12 faces magnet 16, then a S pole of magnet 16 faces magnetic latch pin 12 in order to cause the two magnets to attract each other, such that apparatus 100 is in a locked position.

Spring 30 should be stiff enough to force ferromagnetic magnetic latch pin 12 to retract in the absence of a magnetic attraction between magnet 16 and ferromagnetic magnetic latch pin 12, but not so strong as to prevent motion of magnet 16 and ferromagnetic magnetic latch pin 12 toward each other in the presence of a magnetic attraction between magnet 16 and ferromagnetic magnetic latch pin 12. Thus, the desired stiffness of spring 30 is an engineering balance with the magnetic attraction between magnet 16 and ferromagnetic magnetic latch pin 12. Spring 30 may be made of a dielectric or non-ferromagnetic material, such as a stiff but resilient plastic.

A magnet housing 22 houses and supports magnet 16, holding magnet 16 in a known orientation that changes as magnetic safety gate latch system 100 is operated. Magnet housing 22 is moveably coupled to a twist drive 21. Twist drive 21 in turn is rigidly coupled to twist drive shaft 18. Twist drive 21 may have a helical thread (or thread of similar shape) where twist drive 21 is coupled to magnet housing 22.

Twist drive pin 20 may be inserted through twist drive 21 to engage with twist drive shaft 18, in order to keep twist drive 21 coupled to twist drive shaft 18 and to maintain their relative orientation.

Twist drive 21 may have a larger cross-sectional area in a horizontal plane than twist drive shaft 18, thus providing a surface upon which one end of a compression spring 15 ordinarily rests. Compression spring 15 encircles and is substantially coaxial with twist drive shaft 18. A flange washer 29 is located upon a top end of compression spring 15. As better illustrated in the assembled views of FIG. 3A and FIG. 4A described below, flange washer 29 is pressed against a top inner surface of pool latch bottom insert 9 by compression spring 15. Flange washer 29 provides an unmoveable surface for compression spring 15, whereas an opposite end of compression spring 15 is moveable as magnetic safety gate latch system 100 is operated.

As described above, twist drive shaft 18 is coupled to pool latch lid 5, and twist drive shaft 18 moves up and down as pool latch lid 5 is fully moved up and down. When twist drive shaft 18 is moved up by a user, twist drive 21 also moves up, and the helically-threaded portion of twist drive 21 engages with magnet housing 22 to cause magnet housing 22 to rotate. In some embodiments (not illustrated), magnet housing 22 may include a helical thread either instead of or in addition to a helical thread on twist drive 21. If a 1.0 inch movement of twist drive shaft 18 produces a 90 degree rotation of magnet housing 22, then the pitch of the helical thread is 0.25 threads per inch (TPI), or conversely 4 inches per thread. When the user releases pool latch lid 5, compression spring 15 pushes down upon twist drive 21, causing magnet housing 22 to rotate back into a locked position.

As magnet housing 22 begins to rotate away from a locked state, the magnetic attraction of magnet 16 and magnetic latch pin 12 weakens and finally breaks as the degree of rotation increases. In some embodiments, a combination of pitch of the helically-threaded twist drive 21 and distance of travel of twist drive shaft 18 caused by operation of pool latch lid 5 will cause magnet housing 22 to rotate about 90 degrees, effectively extinguishing the magnetic coupling between magnet 16 and magnetic latch pin 12. Once the magnetic coupling is extinguished, spring 30 will tend to force magnetic latch pin 12 into a fully retracted position, such that magnetic latch pin 12 no longer acts as a physical barrier to prevent opening of a gate relative to an adjacent post.

In other embodiments, if magnetic latch pin 12 itself is a permanent magnet, the same distance of travel of twist drive shaft 18 may cause about a 180 degree rotation of magnet housing 22, thus causing magnet 16 and magnetic latch pin 12 to tend to repel each other.

In other embodiments, when magnetic latch pin 12 itself is a permanent magnet, spring 30 is optional and may be configured to tend to push magnetic latch pin 12 toward magnet 16 in the absence of magnetic coupling between magnet 16 and magnetic latch pin 12, causing the gate to be locked. The gate would be unlocked by rotating magnetic housing 22 such that magnet 16 and magnetic latch pin 12 repel each other. In other embodiments, when magnetic latch pin 12 is a permanent magnet and spring 30 is not used, motion of magnetic latch pin 12 may be caused by only by the force of magnetic attraction or repulsion with magnet 16.

Figure 1B:
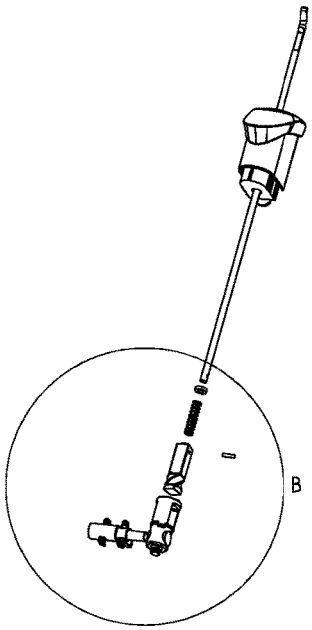
FIG. 1B is an exploded oblique view of an inner portion of the magnetic safety gate latch system of FIG. 1A, in accordance with an embodiment of the present disclosure.

FIG. 1B is an exploded oblique view of an inner portion of magnetic safety gate latch system 100 of FIG. 1A, in accordance with an embodiment of the present disclosure. A portion of FIG. 1B is marked as Detail B.

Figure 1C:
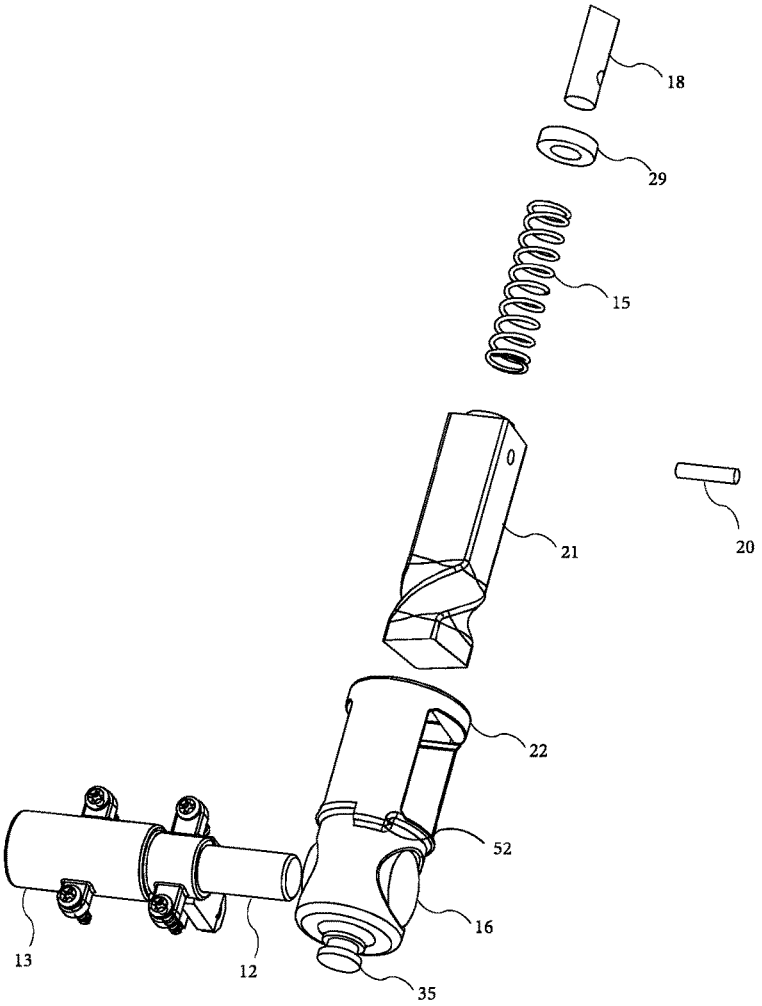
FIG. 1C is a detailed exploded oblique view of a portion of FIG. 1B, in accordance with an embodiment of the present disclosure.

FIG. 1C is a detailed exploded oblique view of a portion of FIG. 1B, in accordance with an embodiment of the present disclosure. FIG. 1C adds a view of tab 52, which may be used as a hard stop to prevent magnetic housing 22 from over-rotating more than a preset amount of rotation, e.g., 90 degrees or 180 degrees.

Figure 2A:
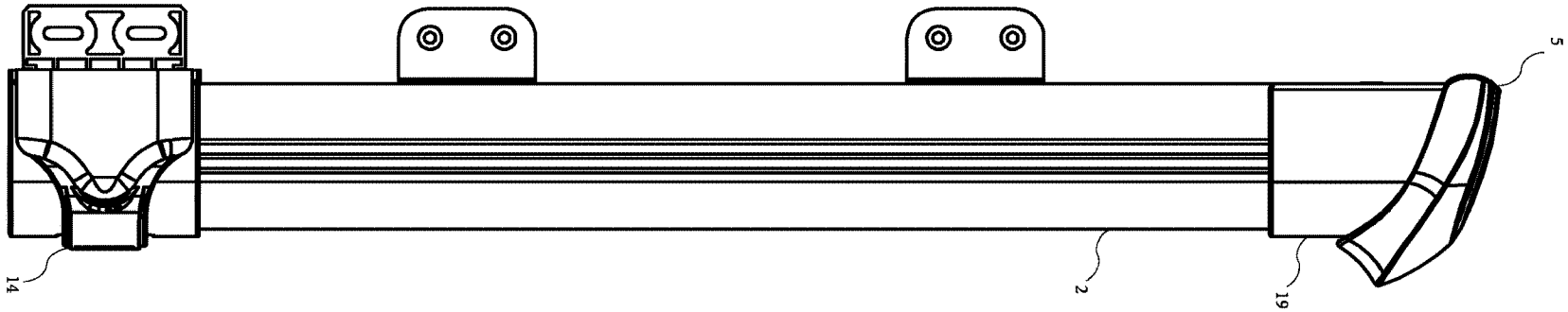
FIG. 2A is an exterior left plan view of a magnetic safety gate latch system in a locked position, in accordance with an embodiment of the present disclosure.
Figure 2B:
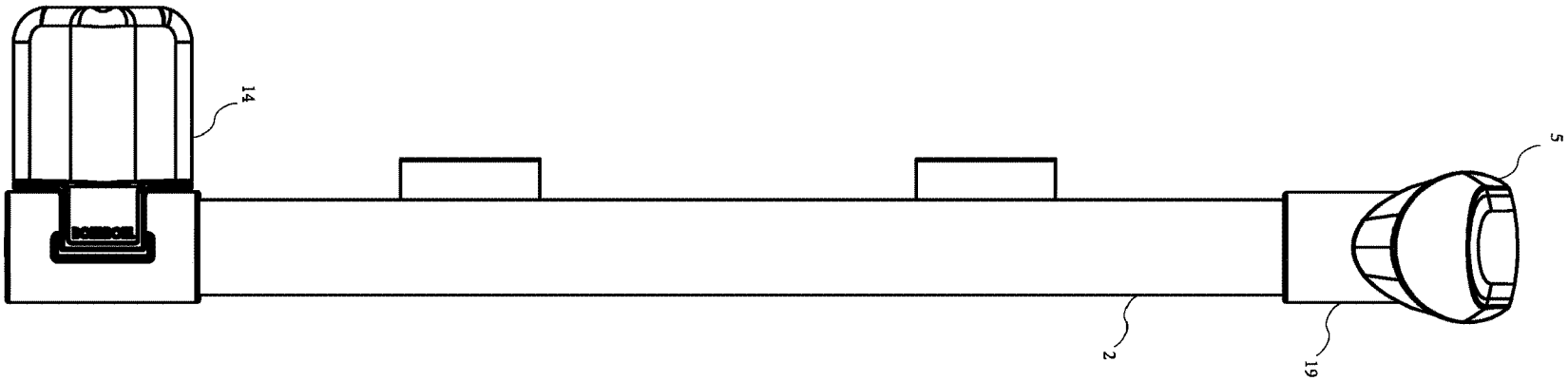
FIG. 2B is an exterior front plan view of a magnetic safety gate latch system in a locked position, in accordance with an embodiment of the present disclosure.
Figure 2C:
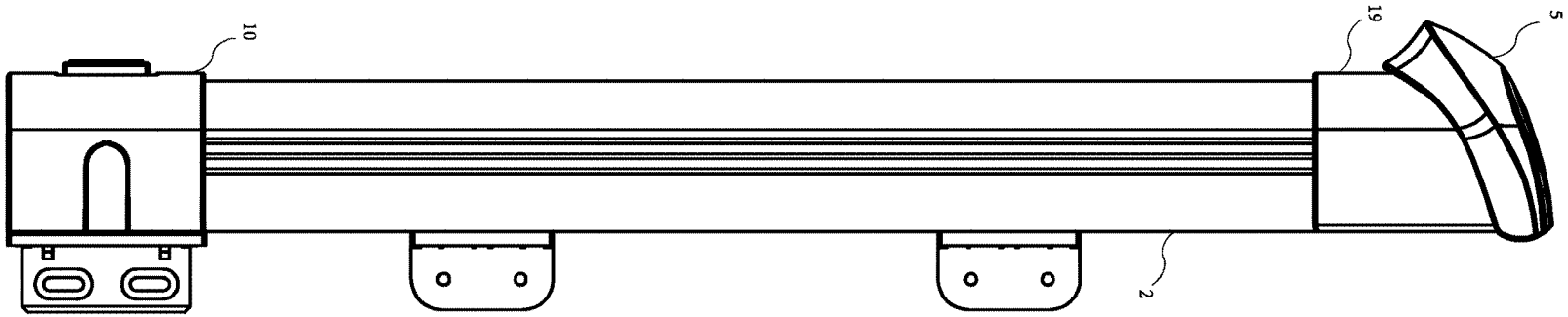
FIG. 2C is an exterior right plan view of a magnetic safety gate latch system in a locked position, in accordance with an embodiment of the present disclosure.
Figure 2D:
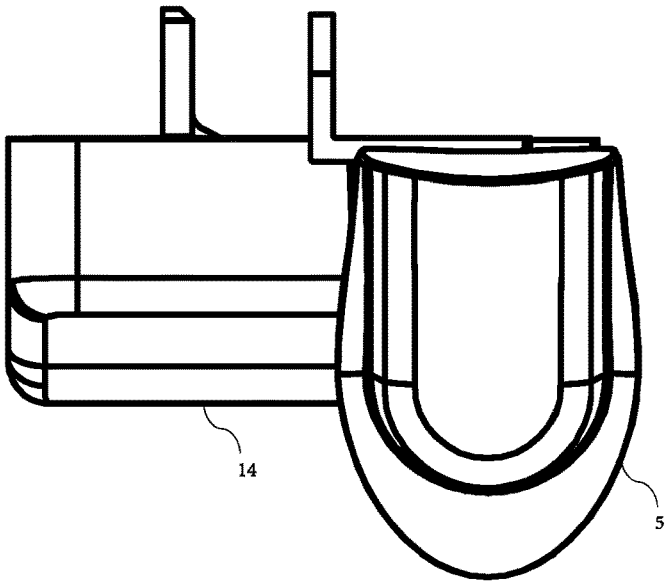
FIG. 2D is an exterior top plan view of a magnetic safety gate latch system, in accordance with an embodiment of the present disclosure.
Figure 2E:
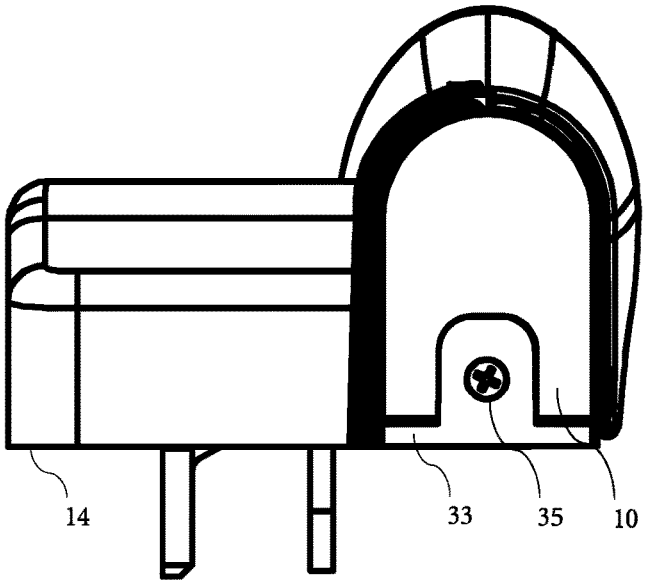
FIG. 2E is an exterior bottom plan view of a magnetic safety gate latch system, in accordance with an embodiment of the present disclosure.

FIG. 2A illustrates a left side plan view of the exterior of magnetic safety gate latch assembly 100, in accordance with an embodiment of the present disclosure. Features illustrated and described with respect to FIG. 1 are assigned like reference numbers. FIG. 2B illustrates a front plan view of magnetic safety gate latch assembly 100, with front defined as the direction facing a user who will be actuating pool latch lid 5 and/or unlocking pool latch lock assembly 1. FIG. 2C illustrates a right plan view of magnetic safety gate latch assembly 100.

Figure 3B:
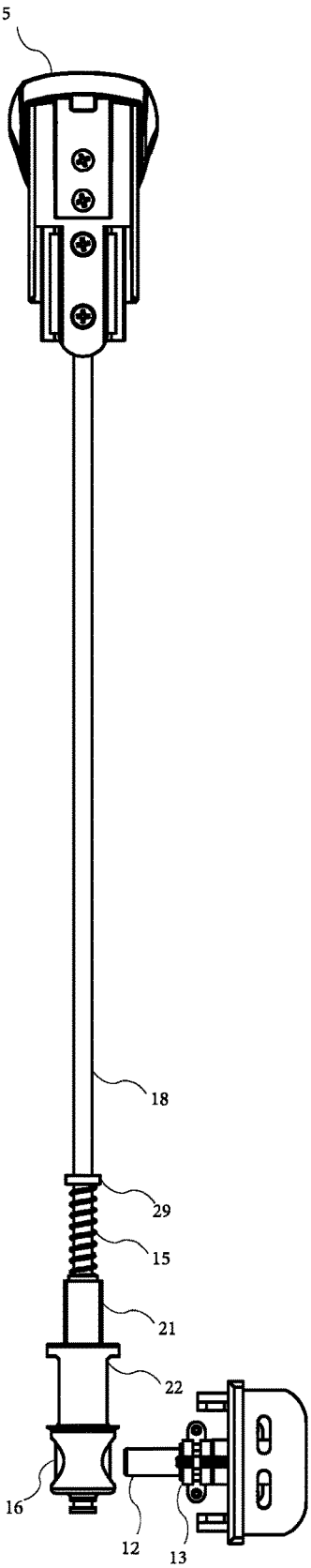
FIG. 3B is an interior rear plan view of a magnetic safety gate latch system in a locked position, in accordance with an embodiment of the present disclosure.

FIG. 3A illustrates a rear cross-sectional plan view of magnetic safety gate latch assembly 100 in a locked position, in accordance with an embodiment of the present disclosure. FIG. 3B illustrates a rear view of the magnetic safety gate latch assembly 100 of FIG. 3A, but without certain exterior elements such as pool latch tube 2, lock pin base cover 11, pool latch cover 14, bottom cover 10 and pool latch bottom insert 9, in order to better illustrate the interrelationship of the remaining elements.

Figure 3C:
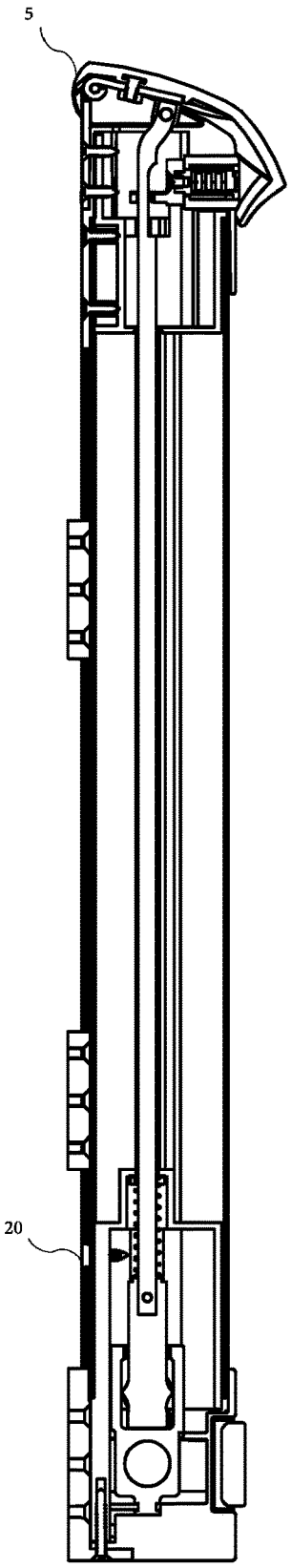
FIG. 3C is a cross-sectional left plan view of a magnetic safety gate latch system in a locked position, in accordance with an embodiment of the present disclosure.
Figure 3D:
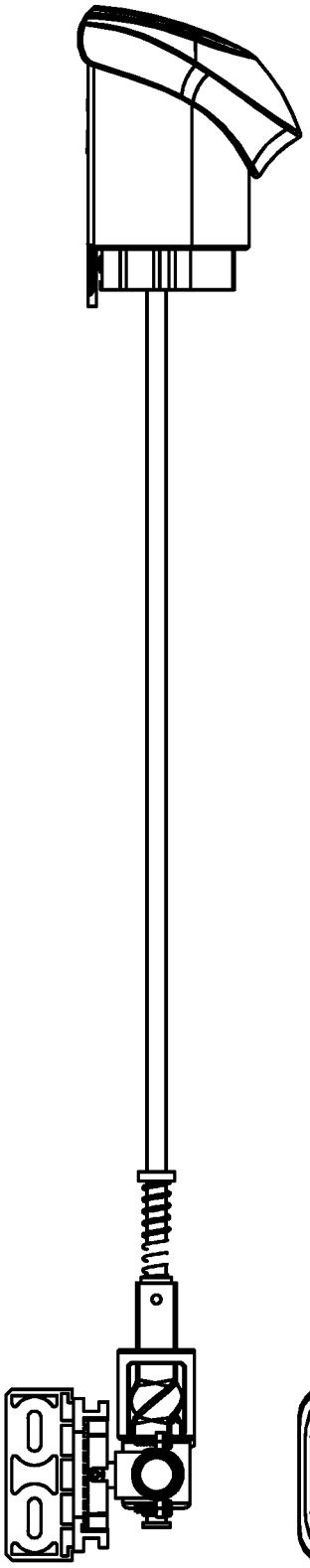
FIG. 3D is an interior left plan view of a magnetic safety gate latch system in a locked position, in accordance with an embodiment of the present disclosure.

FIG. 3C illustrates a left side cross-sectional plan view of magnetic safety gate latch assembly 100 in a locked position, in accordance with an embodiment of the present disclosure. FIG. 3D illustrates the magnetic safety gate latch assembly 100 of FIG. 3C, but with certain exterior elements omitted for clarity.

Figure 3E:
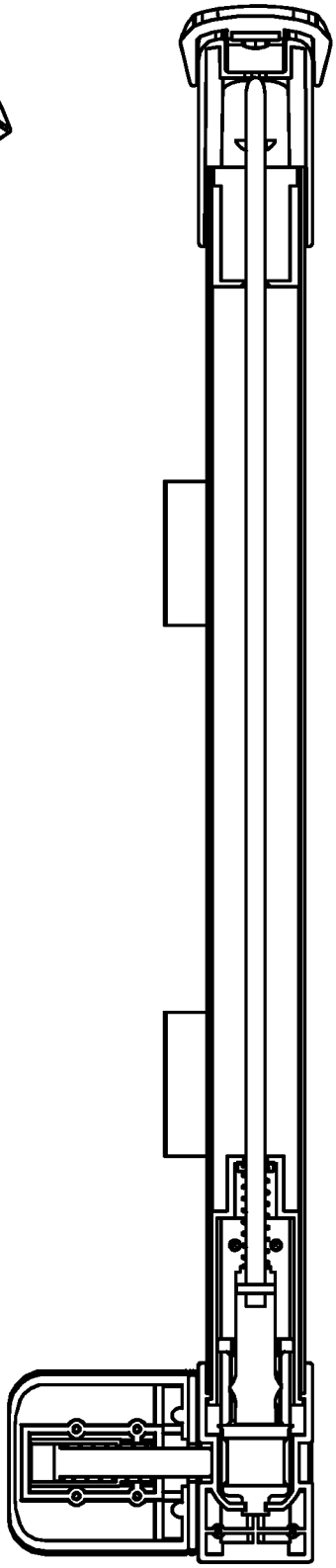
FIG. 3E is a cross-sectional front plan view of a magnetic safety gate latch system in a locked position, in accordance with an embodiment of the present disclosure.
Figure 3F:
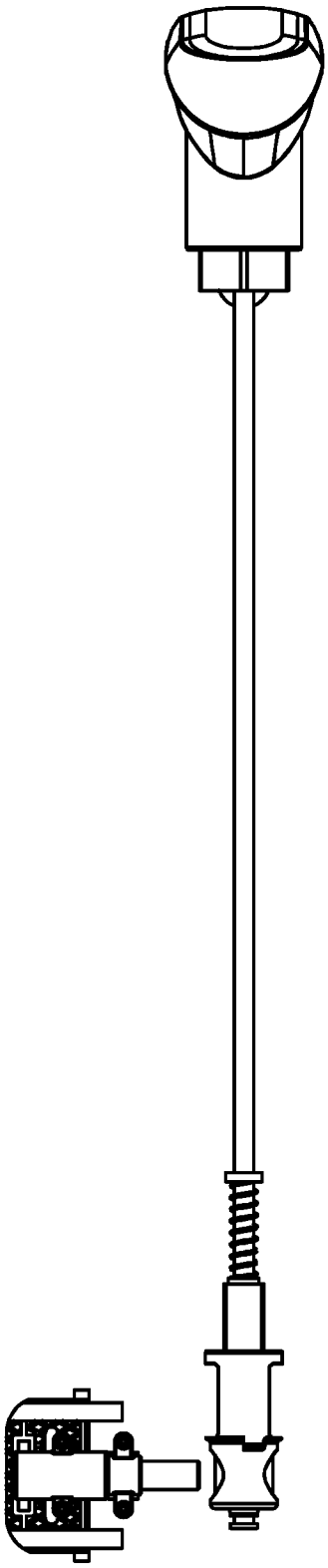
FIG. 3F is an interior front plan view of a magnetic safety gate latch system in a locked position, in accordance with an embodiment of the present disclosure.

FIG. 3E illustrates a front cross-sectional plan view of magnetic safety gate latch assembly 100 in a locked position, in accordance with an embodiment of the present disclosure. FIG. 3F illustrates the magnetic safety gate latch assembly 100 of FIG. 3E, but with certain exterior elements omitted for clarity.

Figure 3G:
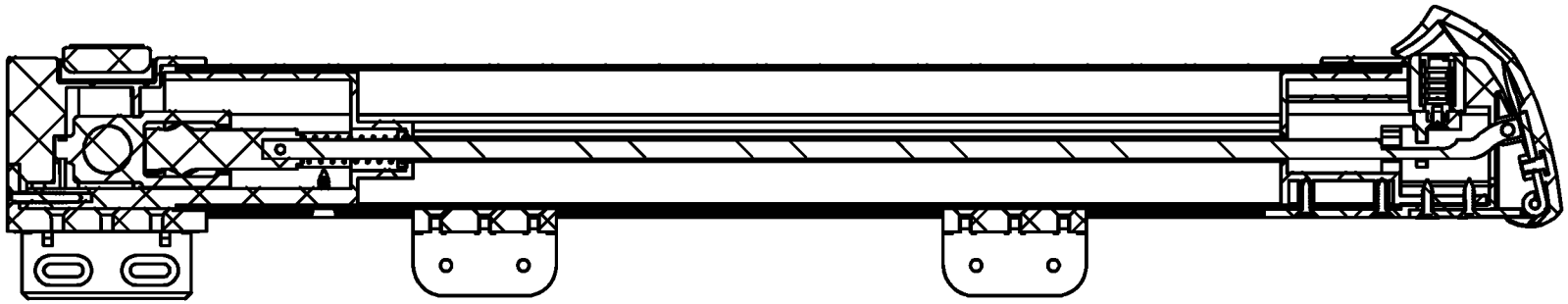
FIG. 3G is a cross-sectional right plan view of a magnetic safety gate latch system in a locked position, in accordance with an embodiment of the present disclosure.
Figure 3H:
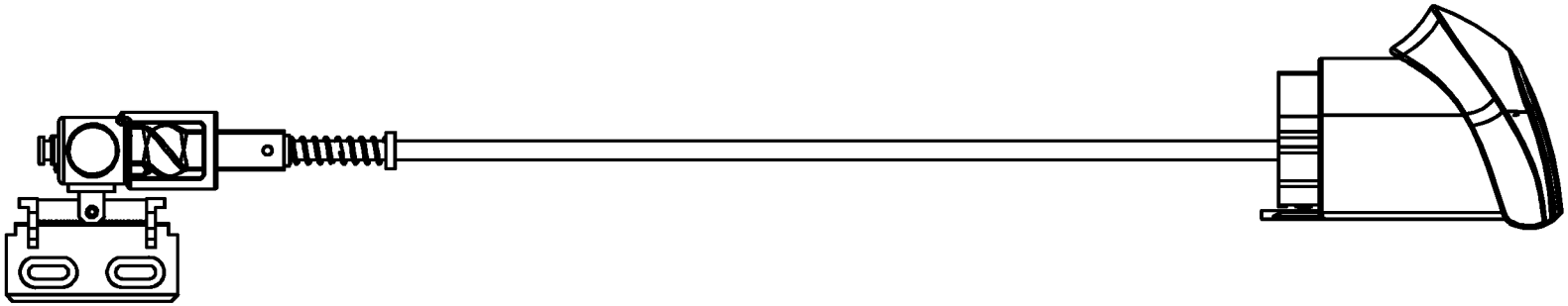
FIG. 3H is an interior right plan view of a magnetic safety gate latch system in a locked position, in accordance with an embodiment of the present disclosure.

FIG. 3G illustrates a right side cross-sectional plan view of magnetic safety gate latch assembly 100 in a locked position, in accordance with an embodiment of the present disclosure. FIG. 3H illustrates the magnetic safety gate latch assembly 100 of FIG. 3G, but with certain exterior elements omitted for clarity.

Figure 4A:
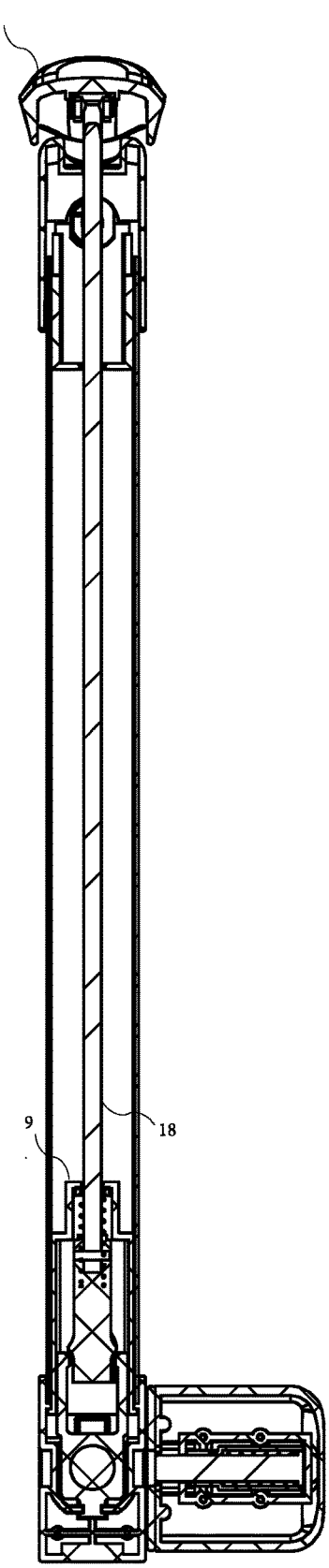
FIG. 4A is a cross-sectional rear plan view of a magnetic safety gate latch system in an unlocked position, in accordance with an embodiment of the present disclosure.
Figure 4B:
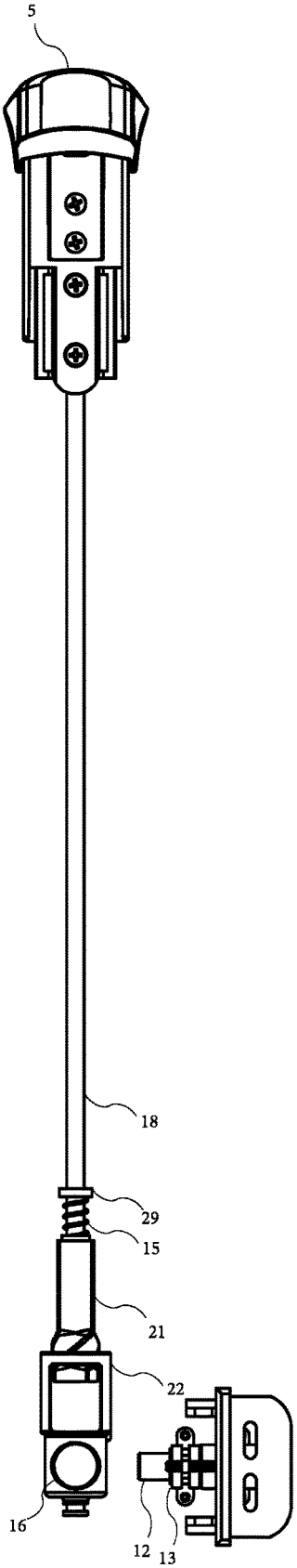
FIG. 4B is an interior rear plan view of a magnetic safety gate latch system in an unlocked position, in accordance with an embodiment of the present disclosure.

FIG. 4A illustrates a rear cross-sectional plan view of magnetic safety gate latch assembly 100 in an unlocked position, in accordance with an embodiment of the present disclosure. FIG. 4B illustrates the magnetic safety gate latch assembly 100 of FIG. 4A, but without certain elements such as pool latch tube 2 such as lock pin base cover 11, pool latch cover 14, bottom cover 10 and pool latch bottom insert 9, in order to better illustrate the interrelationship of the remaining elements.

Figure 4C:
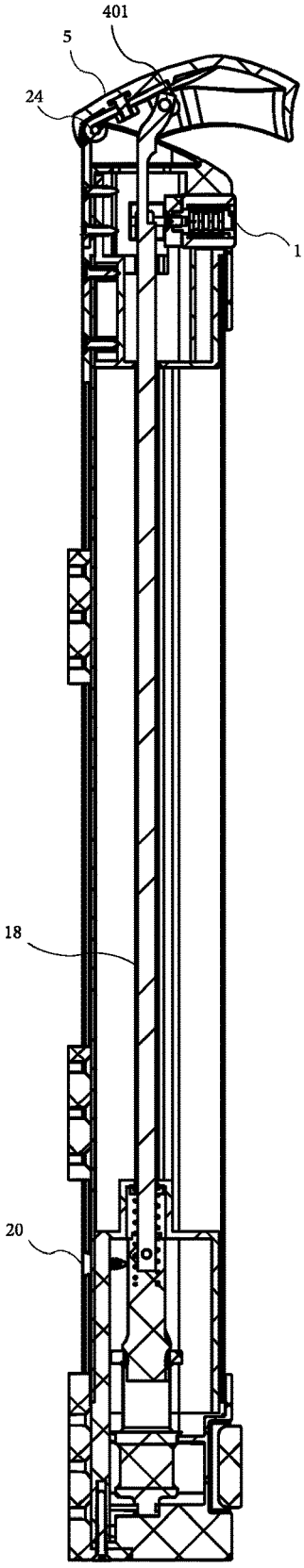
FIG. 4C is a cross-sectional left plan view of a magnetic safety gate latch system in an unlocked position, in accordance with an embodiment of the present disclosure.

FIG. 4C illustrates a left side cross-sectional plan view of magnetic safety gate latch assembly 100 in an unlocked position, in accordance with an embodiment of the present disclosure. Coupling 401 is a point at which pool latch lid 5 is coupled to twist drive shaft 18. As illustrated in FIG. 4C, coupling 401 is not coaxial with pool latch hinge pin 24, such that as pool latch lid 5 is rotated up and down around pool latch hinge pin 24, twist drive shaft 18 will correspondingly be moved up and down.

Figure 4D:
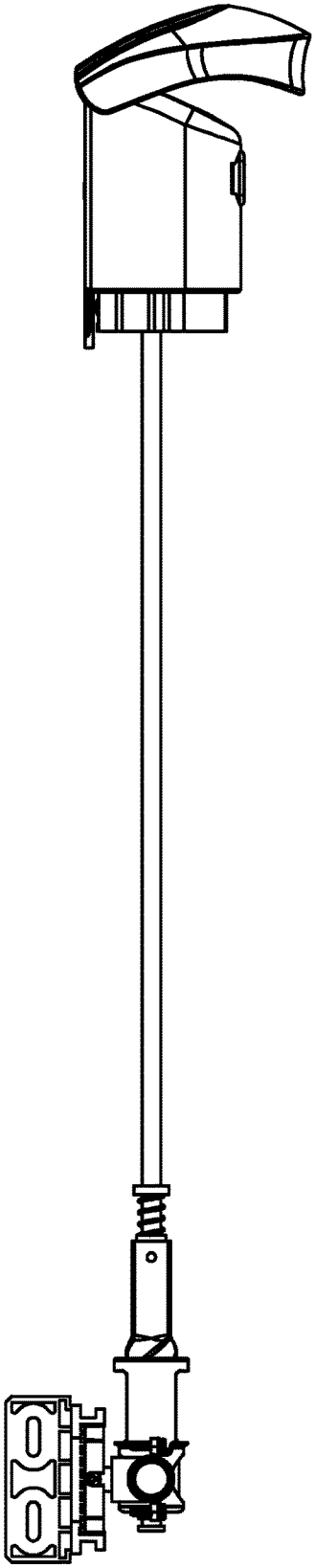
FIG. 4D is an interior left plan view of a magnetic safety gate latch system in an unlocked position, in accordance with an embodiment of the present disclosure.

FIG. 4D illustrates the magnetic safety gate latch assembly 100 of FIG. 4C, but without certain exterior elements.

Comparing FIGS. 4A-4C in an unlocked position to FIGS. 3A-3C in a locked position, it can be seen in the former that pool latch lid 5 has been lifted up, and pool latch lock assembly 1 is accessible. Twist drive shaft 18 has been pulled up by the user action of lifting pool latch lid 5, as best seen in FIG. 4C. Twist drive shaft 18 in turn pulls up twist drive 21. As twist drive 21 pulls up, magnet housing 22 rotates around a vertical axis. At full travel of pool latch lid 5, magnet housing 22 has been rotated by 90 degrees compared to the configuration of FIGS. 3A-3C, thus breaking the magnetic attraction between magnet 16 and magnetic latch pin 12. Spring 30 will tend to push magnetic latch pin 12 back within magnet housing 22 once the magnetic attraction is broken.

Figure 4E:
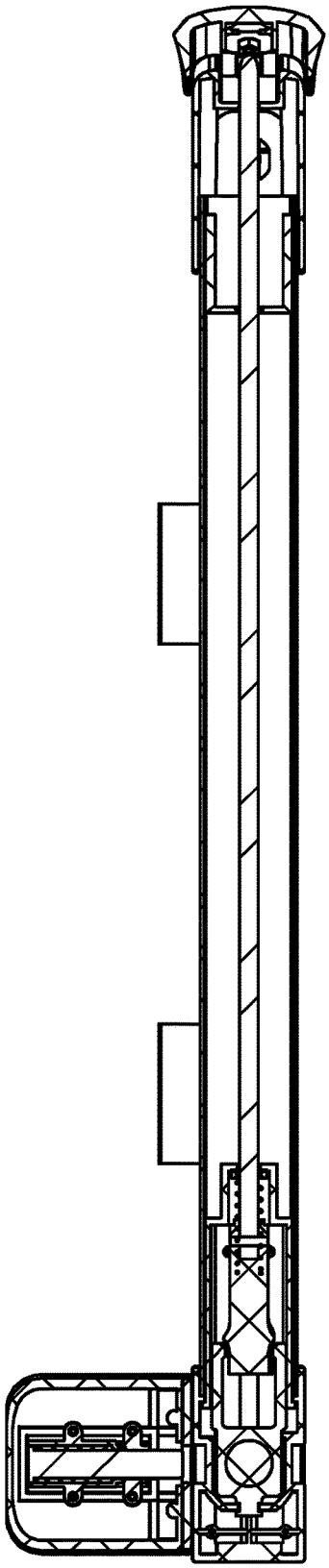
FIG. 4E is a cross-sectional front plan view of a magnetic safety gate latch system in an unlocked position, in accordance with an embodiment of the present disclosure.
Figure 4F:
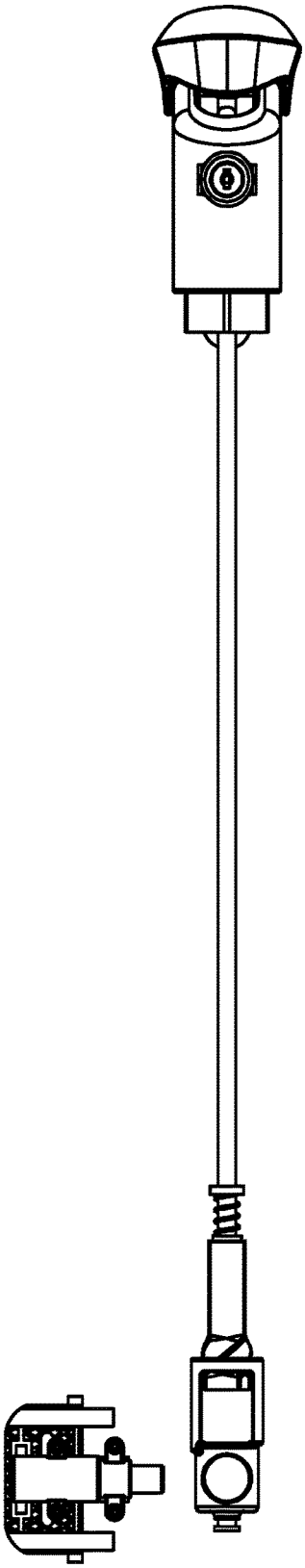
FIG. 4F is an interior front plan view of a magnetic safety gate latch system in an unlocked position, in accordance with an embodiment of the present disclosure.

FIG. 4E illustrates a front cross-sectional plan view of magnetic safety gate latch assembly 100 in an unlocked position, in accordance with an embodiment of the present disclosure. FIG. 4F illustrates the magnetic safety gate latch assembly 100 of FIG. 4E, but without certain elements.

Figure 4G:
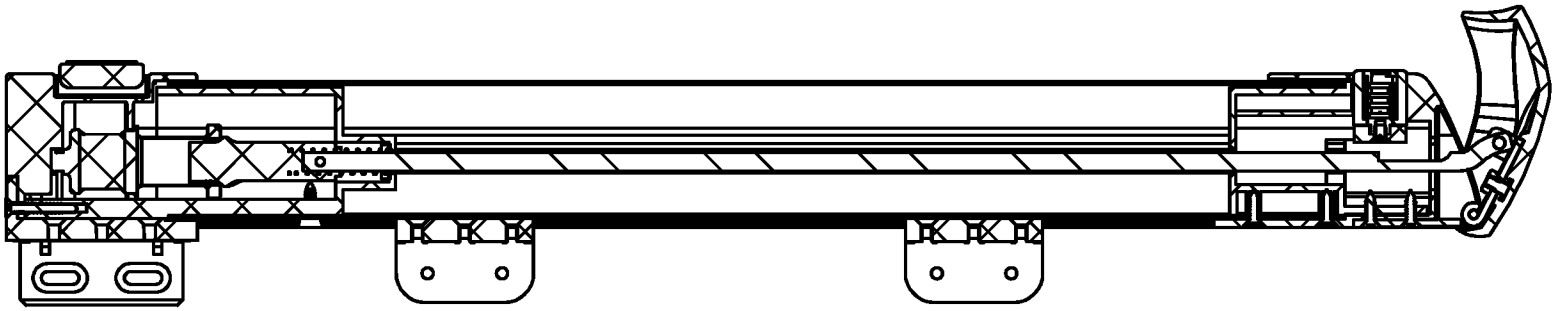
FIG. 4G is a cross-sectional right plan view of a magnetic safety gate latch system in an unlocked position, in accordance with an embodiment of the present disclosure.
Figure 4H:
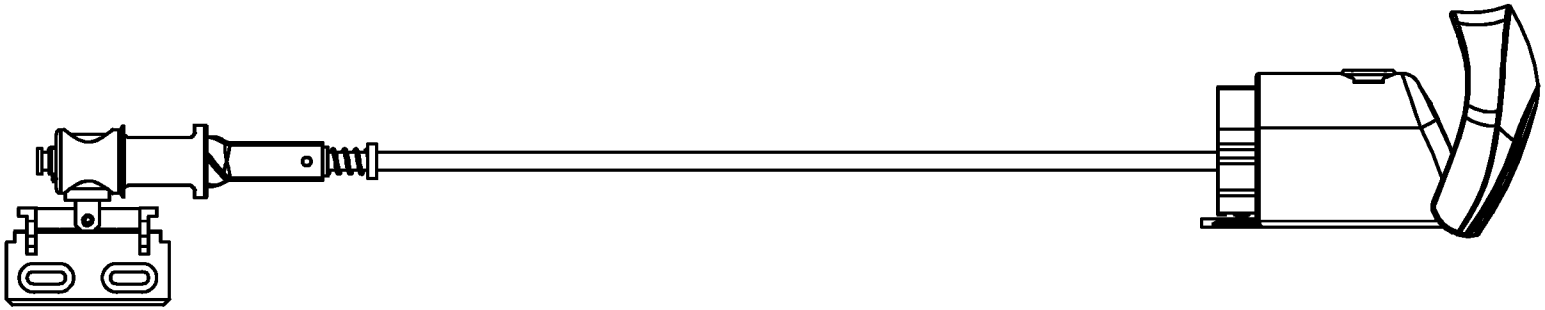
FIG. 4H is an interior right plan view of a magnetic safety gate latch system in an unlocked position, in g accordance with an embodiment of the present disclosure.

FIG. 4G illustrates a right side cross-sectional plan view of magnetic safety gate latch assembly 100 in a locked position, in accordance with an embodiment of the present disclosure. FIG. 4H illustrates the magnetic safety gate latch assembly 100 of FIG. 4G, but without certain elements.

Figure 4I:
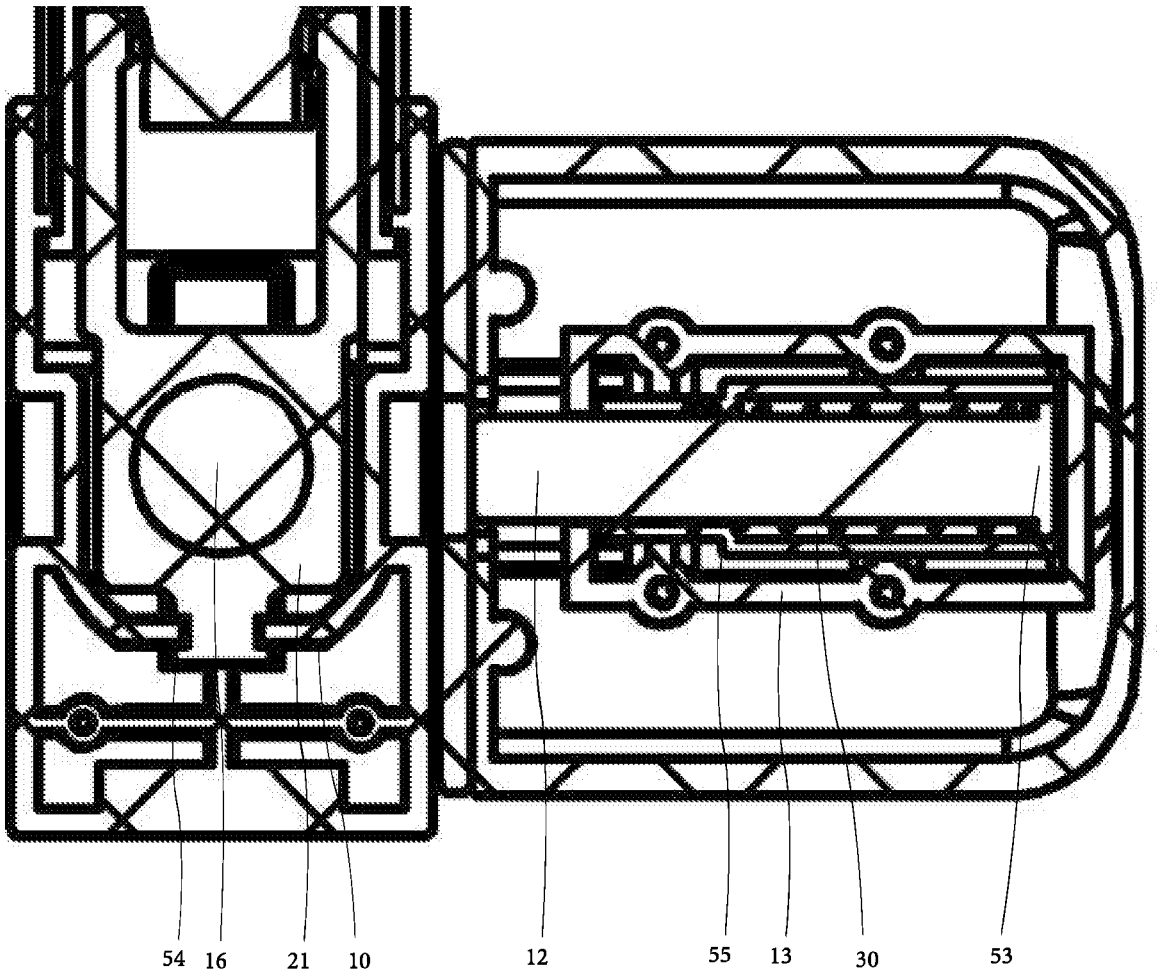
FIG. 4I is detailed view of a portion of FIG. 4A, in accordance with an embodiment of the present disclosure.

FIG. 4I illustrates a detailed view of a portion of the cross-sectional view of FIG. 4A, in accordance with an embodiment of the present disclosure. FIG. 4I illustrates magnetic safety gate latch assembly 100 in an unlocked position, i.e., a face of magnet 16 is illustrated parallel to the plane of FIG. 4I and facing away from magnetic latch pin 12. FIG. 4I better illustrates placement of spring 30 inside magnetic latch pin guide 13, concentrically encircling magnetic latch pin 12. Magnetic latch pin 12 includes a flanged portion 53 located at a distal end of magnetic latch pin 12, distal from magnet 16. One end of spring 30 pushes against flanged portion 53, and the other end end of spring 30 pushes against a shoulder portion 55 of the interior of magnet latch pin guide 13. In the unlocked position of assembly 100, spring 30 will have pushed flanged portion 53 to a distal end of magnetic latch pin guide 13. In a locked position of assembly 100 (not illustrated), magnetic latch pin 12 will be magnetically attracted toward magnet 16, thus forcing spring 30 to be relatively compressed. The potential energy stored in spring 30 by the compression will tend to force magnetic latch pin 12 into an unlocked position once the magnetic attraction to magnet 16 is disrupted.

FIG. 4I further illustrates a flanged portion 54 of twist drive 21. Flanged portion 54 mates with bottom tube cover 10. The mating of flanged portion 54 and bottom tube cover 10 prevents twist drive 21 from moving vertically as twist drive shaft 18 is moved up and down by the user, without preventing twist drive 21 from rotating around a vertical axis.

In an alternate embodiment (not illustrated), a spring within magnetic latch pin guide 13 may be fixedly attached to an interior end face of magnetic latch pin guide 13 and a facing surface of flanged portion 53. The spring may be sized such that in a state of the spring that is neither compressed nor stretched, magnetic latch pin 12 may be in an unlocked state when there is no magnetic attraction between magnetic latch pin 12 and magnet 16. When a magnetic attraction is introduced between magnetic latch pin 12 and magnet 16, pulling magnetic latch pin 12 into a locked state, the spring may be stretched. Once the magnetic attraction is removed, the spring may compress and pull magnetic latch pin 12 back into an unlocked state.

In an alternate embodiment (not illustrated) if magnetic latch pin 12 itself is a magnet, a spring within magnetic latch pin guide 13 may be sized and positioned (e.g., within magnetic latch pin guide 13 between flanged portion 53 and a distal end of magnetic latch pin guide 13) such that in a state of the spring that is neither compressed nor stretched, magnetic latch pin 12 may be in a locked state when there is no magnetic repulsion between magnetic latch pin 12 and magnet 16. When a magnetic repulsion is introduced between magnetic latch pin 12 and magnet 16 to force magnetic latch pin 12 into an unlocked state, the spring may be compressed. Once the magnetic repulsion is removed, the spring may decompress and push magnetic latch pin 12 back into a locked state.

Figure 5A:
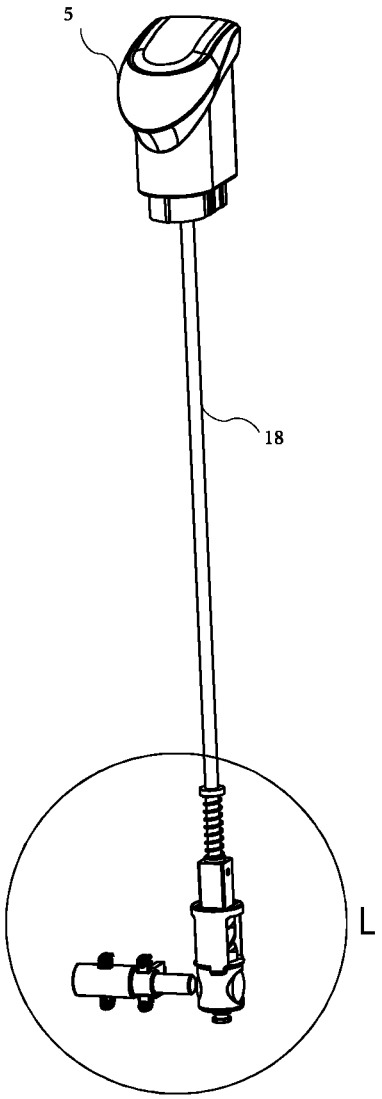
FIG. 5A is an interior front, right and above oblique view of a magnetic safety gate latch system in a closed (i.e., locked) position, in accordance with an embodiment of the present disclosure.
Figure 5B:
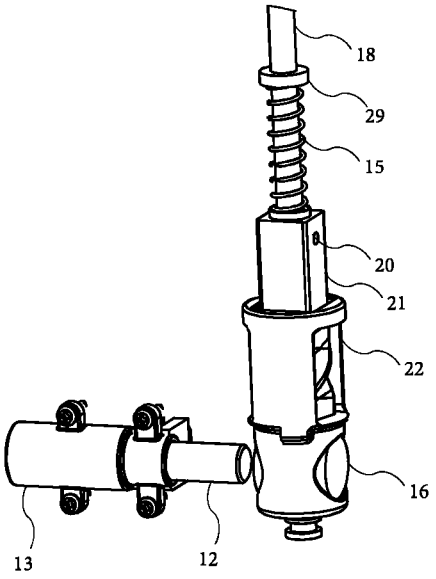
FIG. 5B is a detailed interior front, right and above oblique view of a portion of a magnetic safety gate latch system in a closed position, in accordance with an embodiment of the present disclosure.

FIG. 5A illustrates a front, right, and above oblique view of an interior portion of magnetic safety gate latch assembly 100, in accordance with an embodiment of the present disclosure. FIG. 5A illustrates elements visible in the plan views of FIGS. 3F and 3H. A portion of FIG. 5A is marked as portion "L". FIG. 5B illustrates a detailed view of portion L in a closed (i.e., locked) position. In the closed position, an end of magnet 16 may be facing toward magnetic latch pin 12, thereby attracting magnetic latch pin 12 into a latch groove.

Figure 5C:
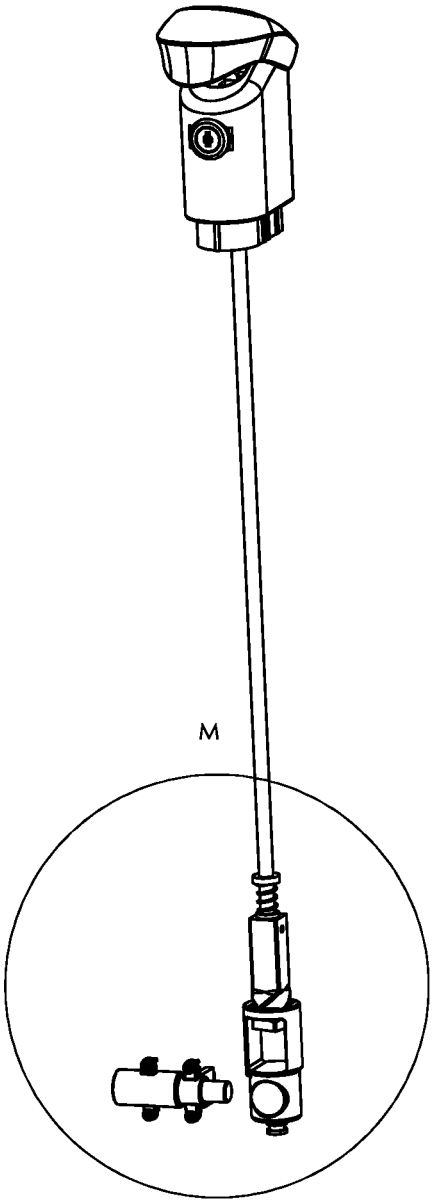
FIG. 5C is an interior front, right and above oblique view of a magnetic safety gate latch system in an open (i.e., unlocked) position, in accordance with an embodiment of the present disclosure.
Figure 5D:
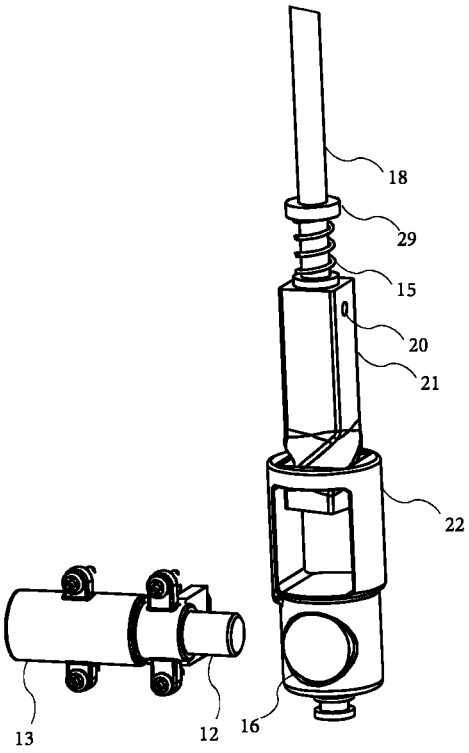
FIG. 5D is a detailed interior front, right and above oblique view of a portion of a magnetic safety gate latch system in an open position, in accordance with an embodiment of the present disclosure.

FIG. 5C illustrates a front, right, and above oblique view of an interior portion of magnetic safety gate latch assembly 100, in accordance with an embodiment of the present disclosure. FIG. 5C illustrates elements visible in the plan views of FIGS. 4F and 4H. A portion of FIG. 5C is marked as portion "M". FIG. 5D illustrates a detailed view of portion M in an open position. Magnet 16 has been turned 90 degrees compared to the configuration of FIG. 5B. Top lid 5 is lifted in order to put assembly 100 into an open (i.e., unlocked) position by spinning magnet 16 such that magnet 16 disengages with magnetic latch pin 12. In the open position, an end of magnet 16 may be facing away from magnetic latch pin 12, thereby not attracting magnetic latch pin 12 into a latch groove. In other embodiments (not illustrated), if magnetic latch pin 12 is a permanent magnet, magnet 16 may be turned 180 degree, thereby actively repelling magnetic latch pin 12.

Figure 5E:
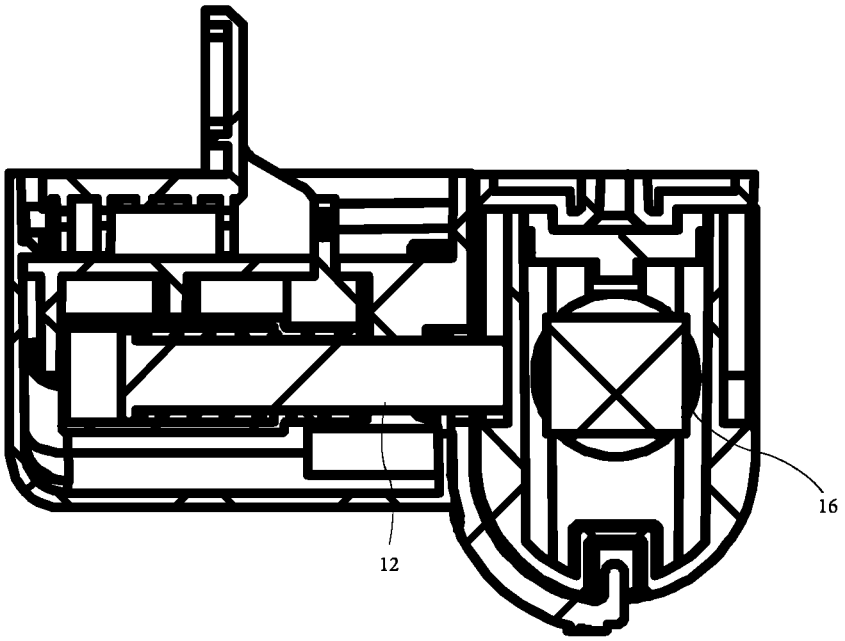
FIG. 5E is a cross-sectional top plan view of a magnetic safety gate latch system in a closed position, in accordance with an embodiment of the present disclosure.

FIG. 5E is a cross-sectional top plan view in a horizontal plane of a magnetic safety gate latch system in a closed position, in accordance with an embodiment of the present disclosure.

Figure 6:
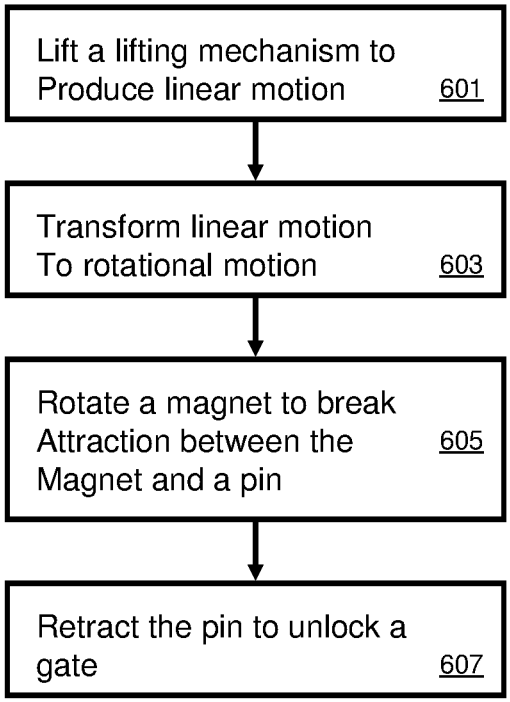
FIG. 6 is a method of operating a magnetic safety gate latch system, in accordance with an embodiment of the present disclosure.

FIG. 6 illustrates a process 600 in accordance with an embodiment of the present disclosure. Process 600 begins with step 601, at which a lifting mechanism such as pool latch lid 5 is lifted in order to produce a linear motion (e.g., in a vertical axis) of a component such as twist drive shaft 18.

Next, process 600 transitions to step 603, at which the linear motion is transformed into a rotational motion, such as a twisting motion of twist drive 21.

Next, process 600 transitions to step 605, at which a magnet (e.g., magnet 16) is rotated by use of the rotational motion, in order to break a magnetic attraction between the magnet and a ferromagnetic pin, e.g., magnetic latch pin 12. Alternatively, step 605 may be described as breaking a magnetic attraction between the magnet and the ferromagnetic pin by rotation of the magnet.

Next, process 600 transitions to step 607, at which the ferromagnetic pin is retracted in order to unlock the gate. For example, a force to retract the pin may be supplied by a spring (e.g., spring 30).

Though the above embodiments are described with reference to a fence gate system and assembly, embodiments of the present disclosure are intended to cover any fence assembly having one or more uprights with inserts pre-installed within the uprights. The pre-installed inserts may be easily coupled with corresponding rails, thereby enabling quick and simple assembly of the fence.

Although the invention has been described with reference to exemplary embodiments, it is not limited thereto. Changes and modifications may be made to the preferred embodiments of the invention and that such changes and modifications may be made without departing from the spirit of the invention. The claims are intended to cover all such equivalent variations as fall within the spirit and scope of the invention.

To avoid unnecessarily obscuring the present invention, the preceding description omits well known structures and devices. This omission is not to be construed as a limitation of the scope of the present invention. Specific details are set forth by use of the embodiments to provide an understanding of the present invention. However, the present invention may be practiced in a variety of ways beyond the specific embodiments set forth herein.

A number of embodiments of the present invention may be practiced. It is possible to provide for some features of the present invention without providing others.

The present invention, in various embodiments, configurations, and aspects, includes components, methods, processes, systems and/or apparatus substantially as depicted and described herein, including various embodiments, sub-combinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing detailed description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are recited expressly in each claim. Rather, as the following claims reflect, inventive aspects lie in less than all features of a single foregoing disclosed embodiment, configuration, or aspect. Thus, the following claims are hereby incorporated into this detailed description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure, without intending to publicly dedicate any patentable subject matter.

What is claimed is:

1. A magnetic safety gate latch assembly comprising:

a first subassembly comprising:

a pool latch tube having a vertical major axis, the pool latch tube comprising a top end and a lower end;

a lift mechanism coupled to the top end of the pool latch tube;

a shaft vertically oriented within the pool latch tube, an upper end of the shaft coupled to the lift mechanism, and a lower end of the shaft comprising a helical thread;

a magnet housing to house a magnet, the magnet housing coupled to the helical threading of the shaft; and a bottom cover coupled to the lower end of the pool latch tube and enclosing the magnet housing, the bottom cover comprising an aperture on a vertical side facing a latch pin housing, the aperture positioned to expose the magnet; and a second subassembly comprising:

the latch pin housing;

a ferromagnetic latch pin; and a magnetic latch pin guide coupled to the latch pin housing and slidably enclosing at least a portion of the latch pin.

2. The fence gate latch assembly of claim 1, wherein the first subassembly is coupled to one of a gate and a fence post, and the second subassembly is coupled to another of the gate and the fence post.

3. The fence gate latch assembly of claim 1, wherein the lift mechanism comprises:

a user-actuated lid rotationally coupled along an axis of rotation to the top end of the pool latch tube, wherein the shaft is coupled to the user-actuated lid at a point not coaxial with the axis of rotation.

4. The fence gate latch assembly of claim 1, wherein the ferromagnetic latch pin comprises a second magnet.

5. The fence gate latch assembly of claim 4, wherein the magnet and the ferromagnetic latch pin repel each other when the lift mechanism is lifted.

6. The fence gate latch assembly of claim 4, wherein the magnet housing is configured to rotate by about 180 degrees when the lift mechanism is lifted.

7. The fence gate latch assembly of claim 1, wherein the ferromagnetic latch pin is slidable between a first position and a second position.

8. The fence gate latch assembly of claim 7, wherein in the first position the ferromagnetic latch pin is positioned entirely within the latch pin housing, and in the second position the ferromagnetic latch pin is position partly within the latch pin housing and partly within the bottom cover.

9. The fence gate latch assembly of claim 1, further comprising a lock to prevent the lift mechanism from being lifted sufficiently to move the magnet.

10. The fence gate latch assembly of claim 9, wherein the lock is hidden when the lift mechanism is not lifted.

11. The fence gate latch assembly of claim 1, further comprising a twist drive pin coupled to the magnet housing, the twist drive pin engaging with the helical thread to transform a linear motion of the shaft to a rotational motion of the magnet housing.

12. The fence gate latch assembly of claim 1, wherein the magnet housing is configured to rotate by about 90 degrees when the lift mechanism is lifted.

13. The fence gate latch assembly of claim 1, wherein a magnetic attraction between the magnet and the ferromagnetic latch pin extinguished when the lift mechanism is lifted.

14. A method to operate a magnetic safety gate latch assembly, comprising the steps of:

lifting a lift mechanism in order to produce a linear motion;

transforming the linear motion to a rotational motion;

rotating a magnet by use of the rotational motion;

breaking a magnetic attraction between the magnet and a ferromagnetic latch pin;

retracting the ferromagnetic latch pin.

* * * * *